US005534114A

United States Patent [19]

Cutright et al.

[11] Patent Number: 5,534,114

[45] Date of Patent: Jul. 9, 1996

[54] METHOD AND APPARATUS FOR APPLYING A MATERIAL TO A WEB

[75] Inventors: Edwin L. Cutright, Powhatan; G. Robert Scott, Midlothian; Howard W. Vogt, Jr., Providence Forge, all of Va.

[73] Assignee: Philip Morris Incorporated, New York, N.Y.

[21] Appl. No.: 847,375

[22] Filed: Mar. 6, 1992

[51] Int. Cl.[6] ..... D21H 19/66; D21H 19/68

[52] U.S. Cl. ..... 162/139; 162/135; 131/365; 118/323; 118/324; 118/325; 118/315; 427/286; 427/424

[58] Field of Search ..... 162/135, 129, 162/139; 118/313, 324, 315, 325, 323, 257, 106, 301, 321; 427/350, 288, 382, 210, 286, 424; 198/816, 813, 806; 131/365; 101/122, 129

[56] References Cited

U.S. PATENT DOCUMENTS

| | | | |
|---|---|---|---|
| 746,786 | 12/1903 | Bundick | 101/122 |
| 1,214,658 | 2/1917 | Dun Lany . | |
| 1,214,659 | 2/1917 | Dun Lany . | |
| 1,513,969 | 11/1924 | Cumfer et al. . | |
| 2,029,273 | 1/1936 | Montgomery | 101/122 |
| 2,112,540 | 3/1938 | McAndrews et al. | 162/186 |
| 2,426,043 | 8/1947 | Muggleton | 162/186 |
| 2,904,448 | 9/1959 | Sorg | 117/38 |
| 3,084,661 | 4/1963 | Roberts | 118/50 |
| 3,090,351 | 5/1963 | Coyne | 118/223 |
| 3,287,207 | 11/1966 | Treat | 162/186 |
| 3,436,245 | 4/1969 | Grundman | 117/25 |
| 3,536,580 | 10/1970 | Fave | 162/186 |
| 3,633,536 | 1/1972 | Morrison | 118/6 |
| 3,687,274 | 8/1972 | Clark et al. | 198/313 |
| 3,705,821 | 12/1972 | Breer . | |
| 3,895,603 | 7/1975 | Barouh et al. | 118/50 |
| 3,921,793 | 11/1975 | Hutchinson | 198/313 |
| 3,923,151 | 12/1975 | Weber | 198/813 |
| 3,961,755 | 8/1976 | Morine et al. | 118/25 |
| 4,239,591 | 12/1980 | Blake | 162/109 |
| 4,305,169 | 12/1981 | Vidalis | 8/149 |
| 4,387,123 | 6/1983 | Wollam et al. | 427/286 |
| 4,583,486 | 4/1986 | Miller | 427/286 |
| 4,739,775 | 4/1988 | Hampl, Jr. | 131/365 |
| 4,800,102 | 1/1989 | Takada | 118/325 |
| 4,945,932 | 8/1990 | Mentzel et al. | 131/365 |
| 4,968,534 | 11/1990 | Bogardy | 427/282 |
| 5,174,435 | 12/1992 | Dorner et al. | 198/813 |

FOREIGN PATENT DOCUMENTS

| | | | |
|---|---|---|---|
| 570440 | 9/1958 | Belgium | 162/139 |
| 1549596 | 12/1968 | France . | |
| 1956906 | 5/1973 | Germany | 162/139 |
| 51-15065 | 5/1976 | Japan | 118/301 |
| 51-19850 | 6/1976 | Japan | 118/301 |
| 246873 | 1/1925 | United Kingdom | 101/122 |

*Primary Examiner*—Brenda A. Lamb
*Attorney, Agent, or Firm*—Charles E. B. Glenn; James E. Schardt; Kevin B. Osborne

[57] ABSTRACT

This invention relates to the treatment of paper with material in repetitive patterns. The treatment patterns made with this invention can be altered by changing apparatus operating parameters.

45 Claims, 6 Drawing Sheets

METHOD AND APPARATUS FOR APPLYING A MATERIAL TO A WEB

BACKGROUND OF THE INVENTION

This invention relates to a method and apparatus for treating paper with material in repetitive patterns. More particularly, the invention relates to a method and apparatus whereby these repetitive treatment patterns can be applied without contact between the paper and the apparatus.

It is well known in the papermaking art that it is desirable to have the capability to alter or enhance the characteristics of paper. For instance, cigarette manufacturers have long appreciated the usefulness of adding flavorings or burn control additives to paper. Another more recent application that has been identified concerns altering cigarette paper so that smoking articles incorporating the altered paper will have a reduced burn rate when the smoking article is not drawn on by the smoker; but have the same feel, taste and burn when drawn on by the smoker at normal intervals.

Cigarette wrappers, i.e., papers, have burn characteristics, including burn rates and static burn capabilities. It is known that burn characteristics can be modified by adding fillers, coatings, or additives to papers. Copending, commonly-assigned U.S. patent application Ser. No. 07/614,620 includes a description of many of these methods, and also discloses a nonlaminated paper of variable basis weight and suggests that burn rate control of this paper can be achieved economically with mass-production techniques. The variable basis weight is achieved by applying bands of slurry in a pattern to a moving paper web during production while leaving regions of the paper between the pattern untreated. Additional slurry increases the basis weight of the paper in treated regions, and when the paper is incorporated in a smoking article, the smoking article has a decreased burn rate in these regions. Although many methods are known for treating paper with material in patterns, limitations of these methods render them less effective for altering the basis weight of cigarette paper in patterns.

For example, many techniques have been developed for imprinting or coating paper webs. These include gravure presses, blade coating, roller coating, silkscreening and stenciling methods. Bogardy U.S. Pat. No. 4,968,534 describes a stenciling apparatus wherein a continuous stencil comes into facing engagement with a paper web during the application procedure. The apparatus includes a preparation step where air is evacuated from the web through the pattern stencil prior to the application step in order to facilitate the treatment procedure. The pattern applied by the device can be altered by changing the stencil used.

The apparatus of Bogardy U.S. Pat. No. 4,968,534 is typical of many of the other previously known treatment devices because the apparatus contacts the paper web during the application process. These previously known devices, as a result, can only be used at points in the papermaking process where the paper is sufficiently stable to withstand the contact. This limits flexibility in placement of these devices, because the devices cannot be incorporated in a papermaking machine at relatively early stages of the papermaking process.

Stenciling and other previously known methods generally transfer a predetermined pattern to a treated article. The only way to change the pattern applied is to replace the pattern-forming element of the device. In other words, there is no easy way to alter the pattern by, for instance, merely changing operating parameters. This characteristic particularly limits the applicability of these devices in mass-production situations where it is desirable to apply several patterns to paper being produced.

Another characteristic of previously known devices like that of Bogardy U.S. Pat. No. 4,968,534 is that the amount of material applied cannot be varied appreciably. In essence, since the devices are in contact with the web, there must be penetration of the web by the material during the application procedure for significant amounts of material to be applied to the web. The required penetration may not be possible depending on the combined characteristics of the paper and the treatment material, thereby resulting in less than optimum treatment of the paper.

A particular limitation of devices like that of Bogardy U.S. Pat. No. 4,968,534 is that a stenciling device incorporating a pattern for applying relatively-closely spaced bands of narrow width to cigarette paper would experience flexure of the stencil and resultant pattern non-uniformity when scaled to the size of a papermaking machine of the type used to make cigarette paper.

A final characteristic of previously known devices is that in order to maintain sufficient pressure, a sump of treatment material is positioned above the stencil. This solution generally requires that sump material be recirculated to a reservoir. This constant recirculation of unused treatment material may allow contamination of the treatment material.

It would be desirable to provide a method and apparatus for treating paper webs which can be easily incorporated into present papermaking machines.

It would be desirable to provide a method and apparatus for treating paper webs without contact between the paper web and the apparatus.

It would be desirable to provide a method and apparatus for applying chemical treatments to paper webs in patterns wherein the pattern applied can be altered by changing machine operating parameters.

It would be desirable to provide a method and apparatus for treating paper webs where the pattern applied can also be altered by replacing the pattern forming element of the apparatus.

It would be desirable to provide a method and apparatus for applying material to moving paper webs where the amount of material applied can be varied appreciably.

It would be desirable to provide a method and apparatus for applying material to moving paper webs in uniform patterns.

It would be desirable to provide a method and apparatus for applying material to moving paper webs where the amount of material being applied can be accurately metered, eliminating the need for recirculation of treatment material.

It would further be desirable to provide a method and apparatus for applying chemical treatments to cigarette paper so that burn rate control can be achieved economically with mass production techniques.

SUMMARY OF THE INVENTION

Accordingly, it is an object of the present invention to provide a durable moving orifice applicator which can be inexpensively manufactured and easily incorporated into a papermaking machine at various points in the papermaking process.

Another object of the present invention is to provide a moving orifice applicator which selectively applies material in a pattern to a paper web without contacting the moving paper web.

Another object of the present invention is to provide a method for treating a paper web where the pattern applied to the web can be changed by altering machine operating parameters.

Another object of the present invention is to provide a method for treating a paper web where the pattern applied to the paper web can be changed by replacing a pattern-forming element.

Another object of this invention is to provide a moving orifice applicator in which the amount of material applied to the paper web can be varied appreciably.

Another object of the present invention is to provide an application method in which a large quantity of web is treated with material in uniform patterns, in a continuous manner, and at high speeds.

Another object of the present invention is to provide an application method where the amount of material being applied can be accurately metered.

Briefly described, the invention comprises an apparatus and method for applying material to paper in a repetitive pattern for the purpose of altering the characteristics of the paper. Although the preferred embodiment describes use of the invention for producing paper with variable burn characteristics, it is expected that the invention could apply many different materials to achieve differing paper characteristics. For instance, the invention can apply compounds which are detectable by electromagnetic means, thus allowing the paper made to be used in security situations. The invention could also be used to apply dyes, inks, or flavorings. It is also contemplated that the invention could treat substrates other than paper.

In the preferred embodiment, the apparatus of this invention, a moving orifice applicator, is mounted on a paper making machine directly over the Fourdrinier wire between the wet line and the couch roll. The applicator consists of continuous steel belt mounted on motor-driven pulleys. The lower traverse of the belt's travel forms the bottom of an enclosed cavity. Orifices on the centerline of the belt are in communication with the cavity. The plane of the lower traverse of the belt is parallel to the plane of the web, and the direction of belt travel is at an angle to the direction of web travel. During operation, slurry is continuously pumped into the enclosed cavity and motion of the belt across the web causes parallel bands of slurry to be applied to the web as slurry passes from the cavity through the orifices and onto the web. The relative angle of bands applied to the web with respect to the web and their spacing can be easily changed by altering the relative angle and speed of the belt and web without having to change the belt as in previously known devices. The width of bands can be changed by altering the application pressure of the slurry without having to change the pattern belt as in previously known devices.

In an alternate embodiment of the invention the moving orifice applicator can be incorporated in a machine to treat finished, dry paper. This embodiment includes a drying means to facilitate the drying of bands applied to the web.

In other alternate embodiments of the invention, the pattern-forming element of the apparatus contains patterns of orifices of either varying sizes or spacings with the result that the pattern applied consists of a repetitive sequence of bands of varying sizes or spacings.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
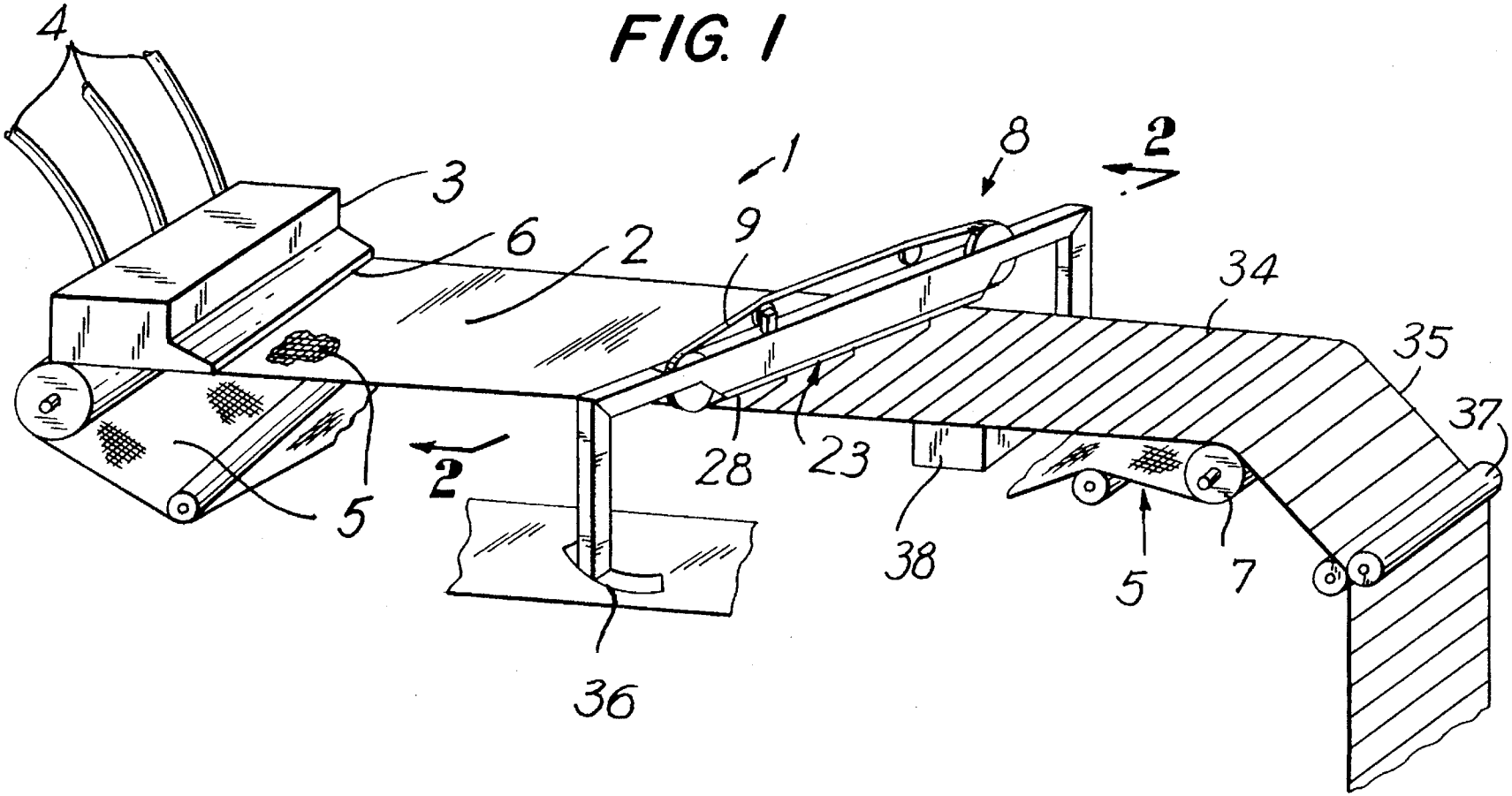
FIG. 1 is a perspective view of a papermaking machine incorporating the present invention.

The present invention relates to a method and apparatus for altering the characteristics of paper by treating the paper during or after the production process. With this invention many different paper characteristics can be achieved. For example, materials that confer distinctive characteristics upon the paper, such as compounds which are detectable by electromagnetic means, could be applied with the invention. Inks, dyes or flavorings could also be applied with the invention. The invention could also be used to apply a pattern of flavor generating material, or a pattern of electrically conductive, resistive or insulating material, for use in a flavor generating article such as that disclosed in commonly assigned U.S. Pat. No. 5,060,671. In addition, the invention could treat substrates other than paper. Although the first preferred embodiment of the invention relates to treatment of cigarette paper, those skilled in the papermaking art will realize that the invention has many applications.

The first preferred embodiment of the invention concerns a method and apparatus for altering the basis weight of cigarette paper in select regions so that the burn rate characteristics are altered in these regions. As used herein, "base web" relates to untreated regions of paper and "cross-directional regions" are the regions of increased basis weight in the cross-direction of web travel. These "cross-directional regions" are achieved by applying "bands" of slurry in an "application pattern."

An increase in basis weight may be achieved by providing a paper with localized regions of either (1) increased thickness or (2) increased density, or both. The increase in basis weight may be accomplished by depositing, onto an existing pulp web in a papermaking machine, additional material such as a second quantity of cellulosic pulp, or, alternatively, a filler material. Some examples of additional materials are highly refined cellulosic pulp, high surface area cellulosic fibers such as cellulon, microcrystalline cellulose such as Avicel or a mixture of highly refined pulp and calcium carbonate. Other insoluble, cellulose-compatible materials could also be used, such as amylopectin or certain modified celluloses.

The cross-directional regions made with this invention preferably have a basis weight above that of the base web. When paper made with the present invention is incorporated in a smoking article, the smoking article has variable burn rate characteristics. For example, the static burn rate of the smoking article is substantially decreased in the cross-directional regions. The regions of increased basis weight have decreased porosity. The rate of oxygen diffusion through the paper in these regions is thereby decreased, retarding combustion of the smoking article.

The dimensions of the cross-directional regions will also affect the burn characteristics of the paper and, consequently, the smoking article. In particular, the width of the cross-directional regions exerts a substantial effect on the burn rate, and the greater the separation between cross-directional regions, the faster a smoking article made from the paper will burn.

The present invention provides a method and apparatus for applying slurry in an application pattern to form the cross-directional regions. The method and apparatus of this invention allow the application pattern to be changed by adjustment of machine operating parameters, thereby altering the spacing and width of the cross-directional regions comprising the application pattern. This allows the same machine to make papers with differing variable burn rate characteristics. The pattern-forming element of the invention can also be replaced. This allows the apparatus of this invention to apply patterns consisting of bands of varying widths or spacings.

The first preferred embodiment of the apparatus of this invention is shown in FIG. 1 which depicts the pulp web-forming area of a conventional Fourdrinier papermaking machine 1, adapted to produce a continuous pulp web 2. A headbox 3 contains a quantity of cellulosic pulp which is supplied to headbox 3 by a plurality of conduits 4 which communicate with a pulp source (not shown). A common pulp source is a pulp storage tank, which is not shown.

Immediately below headbox 3 is an endless forming wire 5. A slice 6 defined in a lower portion of headbox 3 adjacent to wire 5 permits the pulp from the headbox to flow through slice 6 onto the top surface of the wire 5 to form pulp web 2. Slice 6 is usually of narrow vertical width in order to regulate the amount of pulp which flows from headbox 3. The length of slice 6 extends substantially the entire width of pulp web 2.

The top portion of wire 5 is adapted to move forwardly toward a couch roll 7 and away from slice 6. The direction from headbox 3 toward couch roll 7 is the downstream direction. Once the pulp web has been formed, it passes under the apparatus of this invention, a moving-orifice applicator 8, which deposits additional material onto the pulp web 2. This material forms the cross-directional regions which comprise the application pattern. From FIG. 1 it is apparent that the moving orifice applicator 8 does not contact the pulp web 2 during the application procedure.

Figure 2:
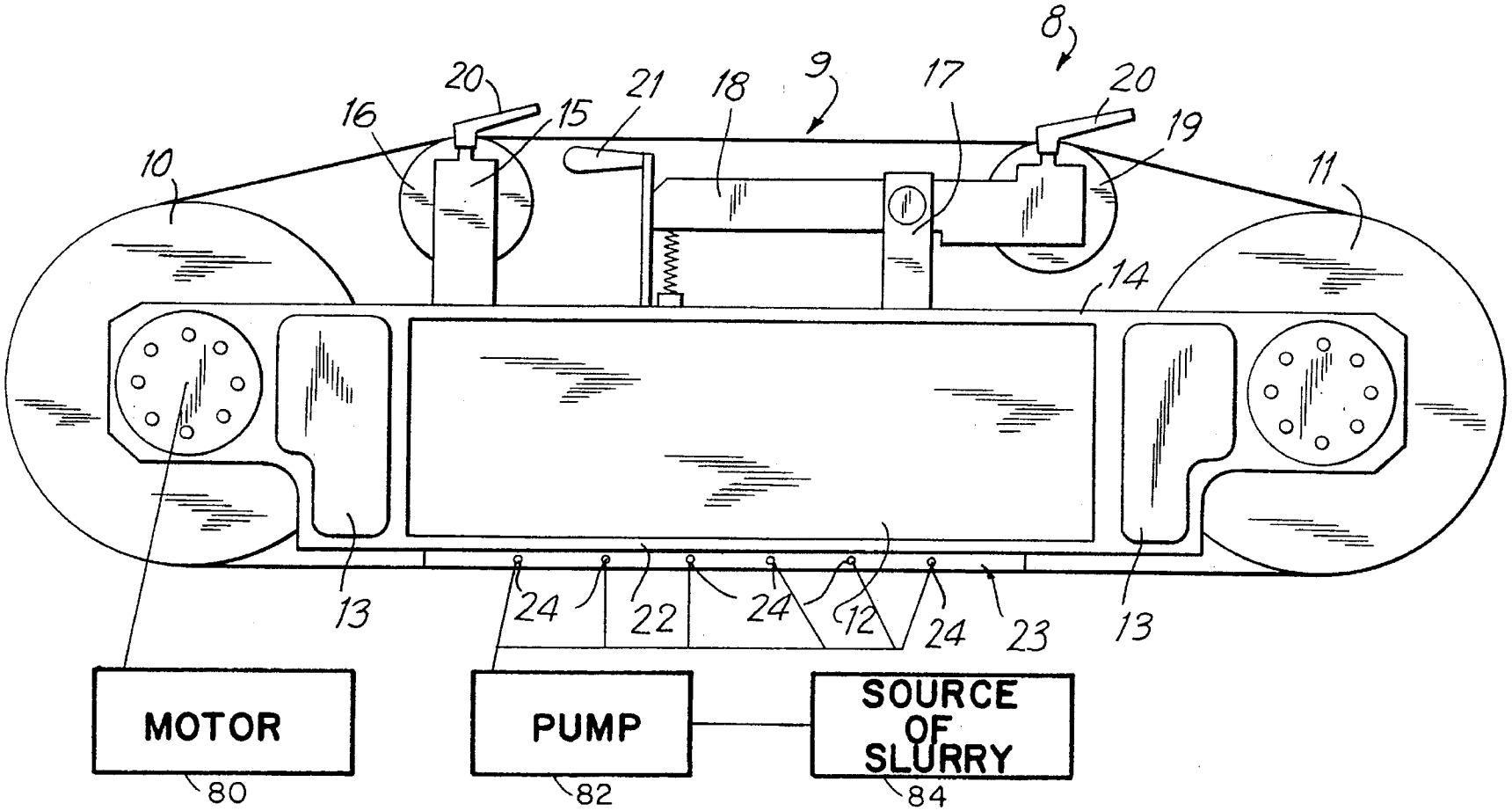
FIG. 2 is a vertical cross-sectional view of a moving orifice assembly in accordance with the invention, taken along line 2—2 of FIG. 1.

As shown to better advantage in FIG. 2, the moving orifice applicator 8 consists in part of a continuous moving belt 9, which preferably is made of steel. The continuous moving belt 9 is mounted on a main drive wheel. 10 and main idler wheel 11. The main drive wheel may be driven for rotation by any suitable motor 80.

The moving orifice applicator 8 has a main frame 12 composed of an I-beam. The main frame 12 could be constructed of cast aluminum. Welded at both ends of frame are brackets 13. These brackets support the main idler wheel 11 and main drive wheel 10.

The main frame 12 has a top flange 14. The top flange 14 supports the fixed idler wheel yoke 15. The fixed idler wheel 16 is mounted in the fixed idler wheel yoke 15. Also mounted on the top flange 14 is the tension pivot yoke 17. The tension yoke 18 is pivotally mounted on the tension pivot yoke 17. The tension wheel 19 is mounted on the tension yoke 18. The axes of the tension wheel 19 and fixed idler wheel 16 can be adjusted by handles 20. This adjustment is necessary so that the continuous moving belt 9 can be steered. Welded steel belts have a tendency to pull to one side or the other. Adjustment of the fixed idler wheel 16 and tension wheel 19 axes by means of the handles 20 ensures that the continuous moving belt 9 tracks properly. The tension yoke 18 also pivots on tension pivot yoke 17. This is adjustable by handle 21. Adjustment of handle 21 alters the tension of the continuous moving belt 9, thereby reducing belt slippage. Handle 21 also relieves tension to facilitate replacement of the continuous moving belt 9.

Mounted to the bottom flange 22 of frame 12 is the cavity block assembly 23. The cavity block housing assembly 23 retains the slurry to be applied to the pulp web during the application procedure. Slurry is supplied under pressure by a suitable pump 82 to the cavity block assembly 23 from a slurry supply source 84 through a plurality of inlets 24.

Figure 3:
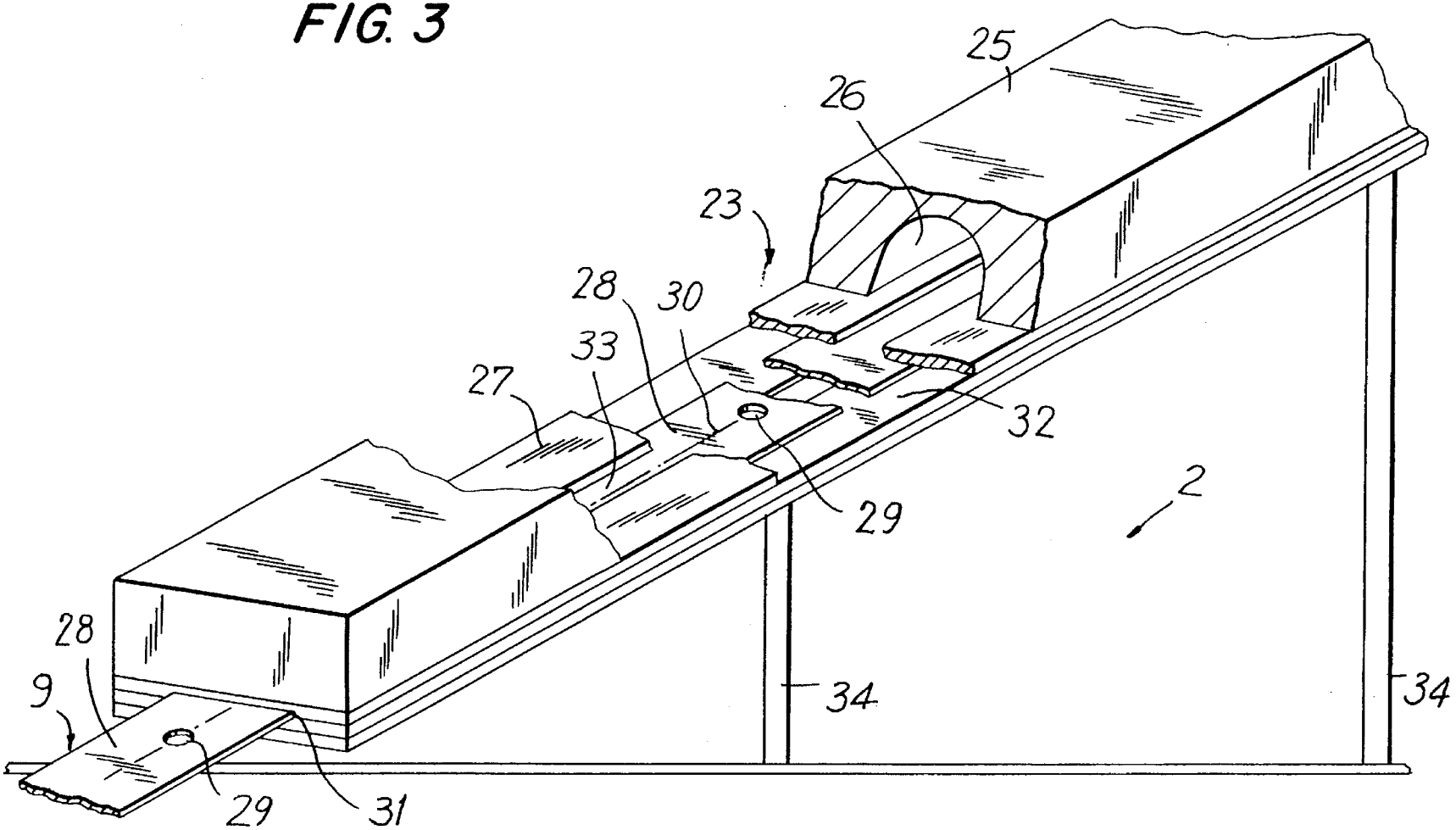
FIG. 3 is a partially fragmentary perspective view of the cavity block assembly of the moving orifice assembly of FIG. 2.

The particulars of the cavity block assembly 23 are shown to better advantage in FIG. 3. The cavity block assembly 23 has a cavity block 25 which encloses an interior cavity 26 on five sides. The cavity block 25 does not enclose the bottom of the cavity 26. Instead a shield 27 and a portion of the lower traverse 28 of the continuous moving belt 9 enclose the bottom of the cavity 26. The continuous moving belt 9 has a plurality of orifices 29 disposed along its center line 30. These orifices 29 are in communication with the cavity 26 during a portion of the lower traverse 28 of the continuous moving belt 9. The continuous moving belt 9 passes through a slot 31 formed by the shield 27 and the cavity floor 32. In order to ensure that the orifices 29 in the continuous moving belt 9 remain in communication with the cavity 26, the shield has a slot 33 machined along its center line. This slot 33 allows the orifices 29 in the continuous moving belt 9 to remain in communication with the cavity 26, while minimizing the amount of slurry in the cavity 26 which contacts the continuous moving belt 9. This is necessary because an unshielded continuous moving belt would have a greater pumping effect on the slurry. This pumping effect is exhibited by a displacement of slurry in the cavity in the direction of travel of the continuous moving belt. If this effect were not minimized through the use of a shield, the application pattern might be less uniform.

As the orifices 29 in the continuous moving belt 9 come into communication with the cavity 26 in the cavity block assembly 23 during the lower traverse 28 of the continuous moving belt 9, slurry which has been supplied to the cavity block assembly 23 is forced out through the orifices 29 and onto the pulp web 2. The motion of each orifice 29 across the pulp web 2 causes a series of bands 34 to be applied to the pulp web 2. These bands 34 constitute the cross-directional regions of the application pattern.

Referring again to FIG. 1, the application pattern 35 formed on the moving paper web consists of a series of equally spaced bands 34, each band 34 being of equal width, and each band perpendicular to web travel. The moving orifice applicator 8 is mounted so that the direction of the lower traverse 28 of the continuous moving belt 9 is at an angle to the direction of travel of the pulp web 2. Accordingly, for the moving orifice applicator 8 to create bands 34 perpendicular to web travel, the lower traverse 28 of the continuous moving belt 9 must have a velocity component in the direction of travel of the pulp web 2 which is equal to the velocity of the pulp web 2.

The orientation of the bands applied to the moving pulp web with respect to the moving pulp web can be altered. For instance, if it is desired that the bands be at an angle to web travel, instead of perpendicular, this can be easily accomplished by changing the relationship of the velocity component of the continuous moving belt 9 in the direction of the pulp web 2 and the velocity of the pulp web 2. As long as they are equal, the bands 34 applied will be perpendicular to web travel. If a differential is introduced, then the bands 34 applied will be at an angle to web travel.

One feature of the invention is that the spacing of the bands can be changed without having to replace the pattern-forming element of the apparatus. In the present invention this is accomplished by changing the angle of the lower traverse 28 of the continuous moving belt 9 while maintaining the component of velocity of the continuous moving belt 9 in the direction of web travel equal to the velocity of web travel. This will ensure that the bands 34 applied remain perpendicular to web travel. This angle change is accomplished by altering the pivot 36.

Another feature of the invention is that the width of bands applied to the moving pulp web 2 can be increased by increasing the application pressure of the material. This is accomplished by increasing the pressure of slurry supplied to the cavity block assembly 23.

An additional feature of the invention is that the amount of material applied to each individual band can easily be increased by decreasing the component of velocity of the continuous moving belt 9 perpendicular to the direction of travel of the moving pulp web 2. In order to maintain a perpendicular application pattern, the velocity of the moving pulp web 2 will have to be decreased.

After the moving orifice applicator 8 has applied the application pattern 35 to the moving pulp web 2, the web continues to move in a downstream direction. As wire 5 begins to move downwardly about couch roll 7 and back toward headbox 3, pulp web 2 is delivered from wire 5 to a plurality of press rolls 37 and then to a dryer section of papermaking machine. (not shown). As pulp web 2 advances in the downstream direction, excess water is permitted to pass through wire 5. A vacuum 38 typically may be applied to at least a portion of the underside of wire 5 to assist in the removal of water from pulp web 2. Couch roll 7 may be adapted to provide a vacuum through wire 5 to the underside of pulp web 2 to remove additional water.

Figure 4:
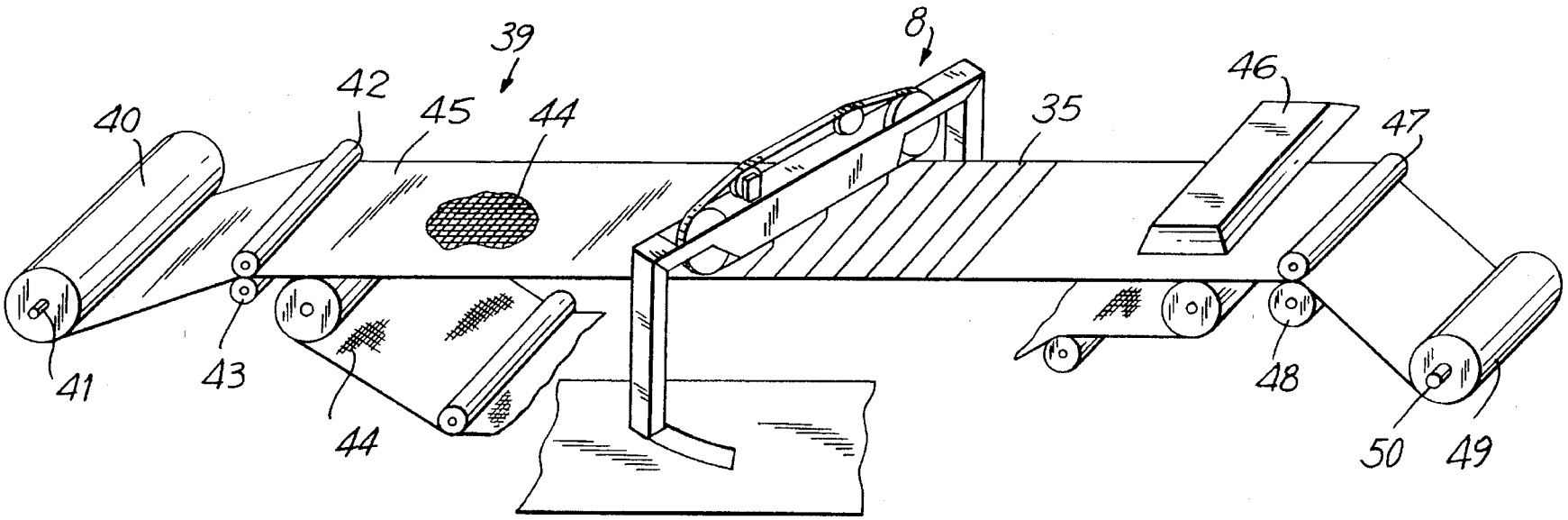
FIG. 4 is a perspective view of an alternative embodiment of the invention.

In an alternate embodiment of the invention shown in FIG. 4, the moving orifice applicator 8 has been incorporated in a machine 39 to treat paper that has already been made. The machine has a roll of premanufactured paper 40 mounted on a feed shaft 41. The paper on the roll 40 is fed between an upper idler 42 and a lower idler 43 and onto a continuous moving web 44. A continuous moving web may not be needed, depending on paper strength. For example, the paper may be supported by a shoe (not shown) familiar to those skilled in the art. The moving orifice applicator 8 is mounted above the continuous moving web 44 which is supporting the paper 45 to be treated. After the application pattern 35 has been applied to the paper 45 by the moving orifice applicator 8, the paper moves underneath a drying means 46. A number of drying means familiar to those skilled in the art including felt absorption, heated drums and infrared drying may be used. After the application pattern 35 has been dried by the drying means 46, the paper moves between the final upper idler 47 and final lower idler 48. The paper 45 is then taken up by a take-up roll 49 mounted on the take-up shaft 50.

Figure 5:
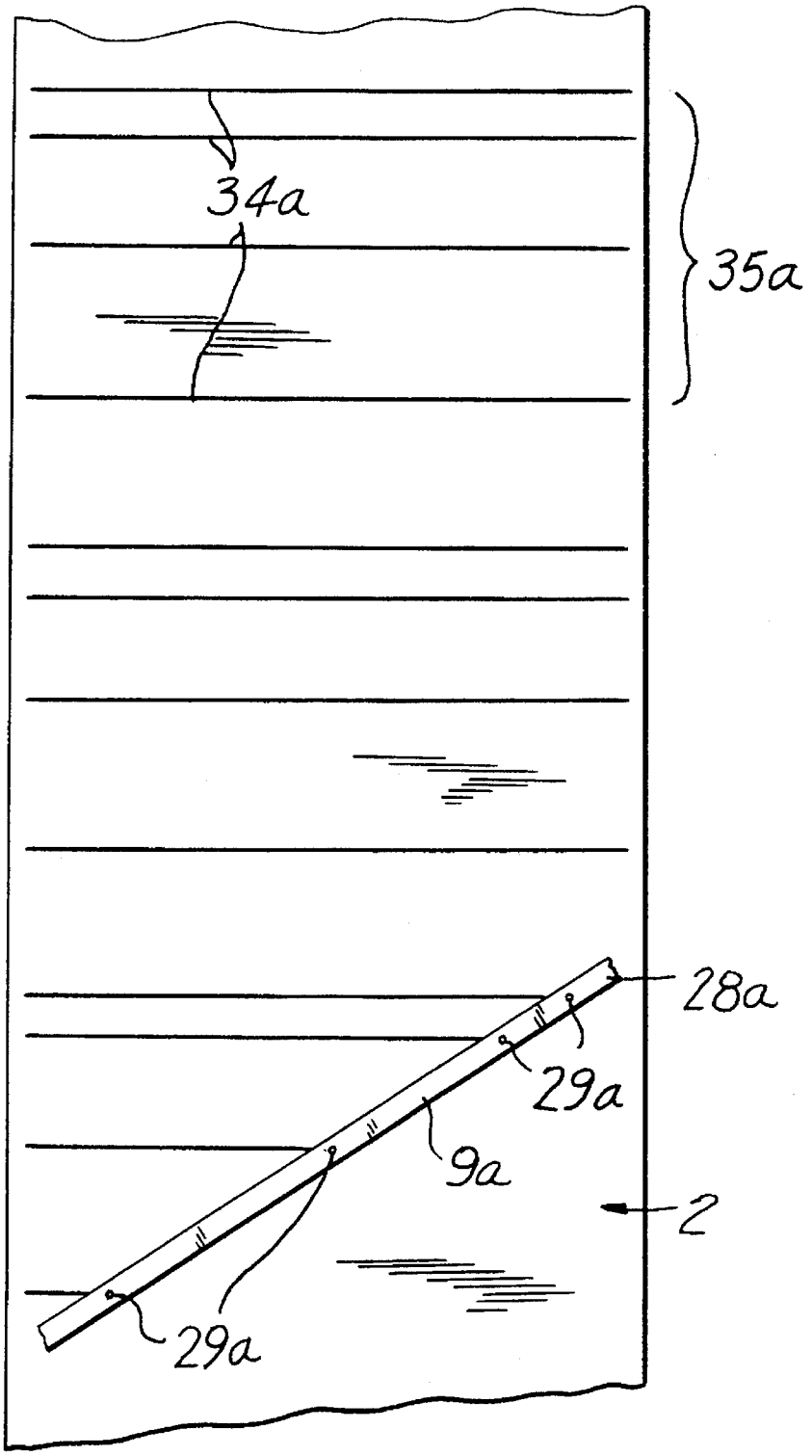
FIG. 5 is a schematic view of an alternative embodiment of the invention.
Figure 6:
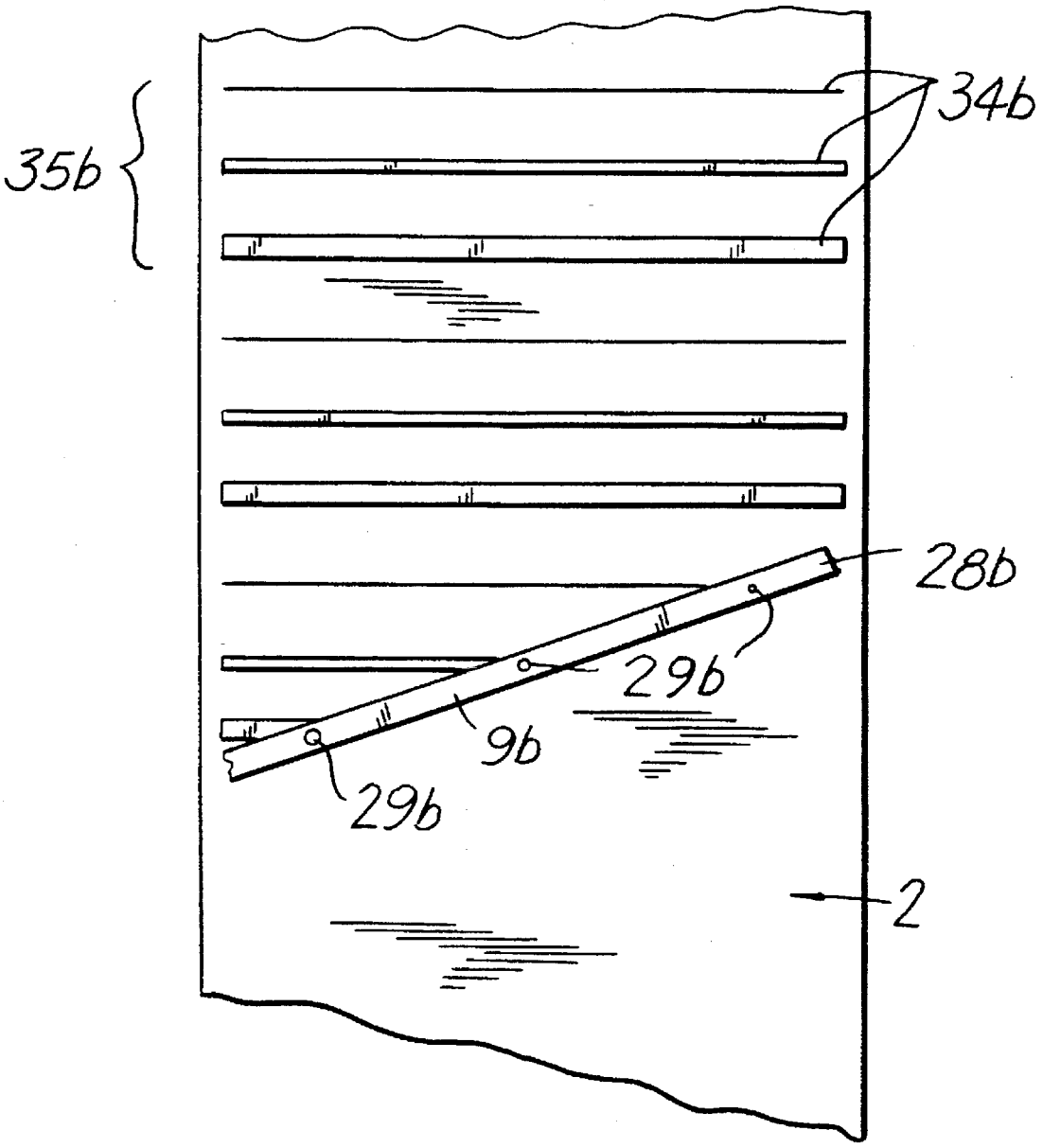
FIG. 6 is a schematic view of an alternative embodiment of the invention.

In other alternate embodiments of the invention it may be desirable to apply bands of material of varying widths or spacings. This may be true whether the paper web being treated has just been made or is premanufactured. FIGS. 5 and 6 and show how this may be accomplished.

In FIG. 5 the lower traverse **28*a* of the continuous moving belt 9*a* is shown in schematic form from above. The continuous moving belt 9 of the first preferred embodiment with its orifices of equal size and spacing has been replaced with a continuous moving belt 9*a* having orifices 29*a* of equal size but varying spacing, the spacing repeating in sequence. In this particular embodiment, the component of velocity of the lower traverse 28*a* of the continuous moving belt in the direction of travel of the moving pulp web 2 is the same as the velocity of the moving pulp web 2 so that bands 34*a* comprising the application pattern 35*a* are perpendicular to the direction of travel of the moving pulp web 2**.

As shown by FIG. 5 the varying spacing of the orifices **29*a* of the continuous belt 9*a* is repeated in the application pattern 35*a* which consists of a series of bands 34*a* of varying spacing, the spacing repeating in sequence. Since the continuous moving belt 9*a* is mounted at an angle to web travel, the actual separation of the bands applied is less than the spacing of the orifices 29*a***.

FIG. 6 shows how the size of bands applied can be varied. Again the lower traverse **28*b* of the continuous moving belt 9*b* is shown from above in schematic form, the lower traverse 28*b* located directly above the moving pulp web 2. The continuous moving belt of the first preferred embodiment with its orifices of equal size and spacing has been replaced with a continuous moving belt 9*b* having orifices 29*b* of equal spacing but varying sizes. Again the component of velocity of the lower traverse 28*b* of the continuous moving belt 9*b* is the same as the velocity of the moving pulp web 2 so that bands 34*b* comprising the application pattern 35*b* are perpendicular to the direction of travel of the moving pulp web 2. As shown by FIG. 6 the sequence of orifices of varying sizes in the continuous moving belt 9*b* is repeated in the application pattern 35*b* which consists of a series of bands 34*b*** of varying sizes, the sizes repeating in sequence.

One skilled in the art will appreciate that the present invention can be practiced by other than the described embodiments, which are presented for purposes of illustration and not of limitation, and the present invention is limited only by the claims that follow.

What is claimed is:

1. A method of applying a fluid material to a substrate, comprising the steps of:

(a) moving said substrate along a first path;

(b) moving at least one orifice along a second endless path, said second endless path including a second path portion which transversely crosses said first path;

(c) retaining a supply of fluid material under pressure, said retaining step including the step of disposing said supply of fluid material under pressure along said second path portion; and (d) discharging said fluid material under pressure from said at least one orifice and onto said substrate by communicating said retained supply of fluid material under pressure with said at least one orifice while said at least one orifice moves along said second path portion so that said fluid material is applied continuously and transversely onto said substrate as said at least one orifice moves along said second path portion.

2. The method of claim 1, wherein said substrate comprises a web.

3. The method of claim 2, wherein said web comprises a paper web.

4. The method of claim 1, wherein said substrate comprises a web;

said moving step (b) includes moving a plurality of spaced-apart orifices along said second path, said second path portion located directly above said first path; and said discharging step (d) includes discharging said fluid material under pressure through said orifices onto said web located directly below said orifices as said orifices travel along said second path portion, said orifices in said second path portion forming an application pattern on said web comprising a series of bands of said fluid material, said bands being substantially parallel.

5. The method of claim 4, wherein said orifices are of substantially equal size, whereby said bands forming said application pattern are of substantially equal size.

6. The method of claim 4, wherein said orifices are of substantially equal spacing, whereby said bands forming said application pattern are of substantially equal spacing.

7. The method of claim 4, wherein said orifices are arranged in a repetitive pattern of varying sizes, whereby said bands forming said application pattern are arranged in a repetitive pattern of varying sizes.

8. The method of claim 4, wherein said orifices are arranged in a repetitive pattern of varying spacings, whereby said bands forming said application pattern are arranged in a repetitive pattern of varying spacings.

9. The method of claim 4, wherein said orifices move at a second velocity, a component of said second velocity of said orifices in said direction of travel of said web is equal to a first velocity of said web along said first path in said direction of travel, so that said bands forming said application pattern are perpendicular to said direction of travel of said web.

10. The method of claim 4, wherein said orifices move at a second velocity, a component of said second velocity of said orifices in said direction of travel of said web is different from a first velocity of said web along said first path in said direction of travel, so that said bands forming said application pattern are at an oblique angle to said direction of travel of said web.

11. The method of claim 4, wherein widths of said bands forming said application pattern are altered by changing said pressure of said fluid material.

12. The method of claim 4, wherein said orifices move at a second velocity, amount of said material applied to said bands is varied by altering a component of said second velocity of said orifices perpendicular to said direction of travel of said web along said first path in said direction of travel.

13. The method of claim 4, comprising the further step of applying a vacuum to said web after said fluid material has been applied to said web.

14. The method of claim 4, comprising the further step of drying said web after said fluid material has been applied to said web.

15. The method as claimed in claim 1, wherein said moving step (b) includes moving a continuous belt along said second path, said at least one orifice being arranged on said continuous belt, said retaining step including the step of supplying said fluid material under pressure to a housing, said housing having an open bottom portion extending along said second path portion, said bottom being enclosed by portions of said continuous belt moving along said second path, said at least one orifice communicating with said fluid material in said housing as said at least one orifice arranged on said continuous belt moves along said housing bottom portion.

16. A method of applying a fluid material to a web comprising the following steps;

(a) moving said web at a first velocity along a first path in a direction of travel;

(b) moving a plurality of orifices in sequence alone a second endless path at a second velocity, said second path including a second path portion which crosses said first path at an angle, said second path portion located directly above said first path; and (c) discharging said fluid material under pressure through said orifices onto said web located directly below said orifices as said orifices travel along said second path portion, said orifices in said second path portion forming an application pattern on said web comprising a series of bands of said fluid material, said bands being substantially parallel, wherein said web comprises a paper web and said fluid material comprises a slurry applied in said application pattern to alter burn rate characteristics of said paper web.

17. A method of applying a fluid material to a web moving at a first velocity in a direction of travel, comprising the following steps:

(a) driving a continuous moving belt located above said web and extending across width of said web at a second velocity, said continuous moving belt out of contact with said web, said continuous moving belt having an inner surface and an outer surface said continuous moving belt having a plurality of orifices disposed in a pattern along an extent of said continuous moving belt, said pattern described by size and spacing of orifices said continuous moving belt having a lower traverse in which said orifices in said continuous moving belt move across said web, plane of said lower traverse parallel to plane of said web, and said lower traverse crossing said web at an angle to said direction of travel of said web;

(b) supplying said fluid material under pressure to said inner surface of a portion of said continuous moving belt forming said lower traverse of said continuous moving belt;

(c) discharging under pressure said fluid material supplied to said portion of said continuous moving belt through said orifices located in said lower traverse and onto said web located directly below said lower traverse, as said orifices in said lower traverse move across said web, said orifices in said lower traverse forming an application pattern on said web comprising a series of bands of said fluid material, said bands being substantially parallel, wherein said web comprises a paper web and said fluid material comprises a slurry applied in said application pattern to alter burn rate characteristics of said paper web.

18. A moving orifice applicator for applying a fluid material to a substrate, comprising:

means for moving said substrate along a first path;

means for moving at least one orifice along a second endless path, said second endless path including a second path portion which crosses said first path; and a housing assembly comprising:

means for retaining a supply of fluid material alone said second path portion and under pressure; and means for communicating said retained supply of fluid material under pressure with said at least one orifice while said at least one orifice moves along said second path portion, so that while said at least one orifice moves along said second path portion said fluid material is discharged under pressure from said at least one orifice continuously and transversely upon said substrate.

19. The moving orifice applicator of claim 18, wherein said substrate comprises a web.

20. The moving orifice applicator of claim 19 wherein said web comprises a paper web.

21. The moving orifice applicator of claim 18 wherein said substrate comprises a moving web, the orifice moving means comprising;

a continuous moving belt having an inner and an outer surface, said continuous moving belt having a plurality of orifices, said continuous moving belt having a lower traverse extending along said second path portion, said lower traverse of said continuous moving belt located above said moving web, said lower traverse at an angle to a direction of travel of said moving web, and said continuous moving belt moving at a velocity; and means for driving said continuous moving belt;

said housing being disposed above said lower traverse of said continuous moving belt, said inner surface of said continuous moving belt forming a bottom portion of said housing so that said fluid material is expelled under pressure only through said orifices in said continuous moving belt and onto said moving web; and means for supplying said fluid material under pressure to said housing.

22. The moving orifice applicator of claim 21 wherein said angle of said lower traverse of said continuous moving belt is variable.

23. The moving orifice applicator of claim 21 further comprising means for adjusting the pressure of said fluid material supplied by the supply means.

24. The moving orifice applicator of claim 21 wherein said drive means includes means for adjusting the velocity of said continuous moving belt.

25. The moving orifice applicator of claim 21, wherein said orifices are of substantially equal size.

26. The moving orifice applicator of claim 21, wherein said orifices in said continuous moving belt are arranged in a repetitive pattern of varying sizes.

27. The moving orifice applicator of claim 21, wherein said orifices are of substantially equally spacing along said continuous moving belt.

28. The moving orifice applicator of claim 21, wherein said orifices are spaced along said continuous moving belt in a repetitive pattern of varying spacings.

29. The moving orifice applicator of claim 21, wherein said orifices are disposed along the centerline of said continuous moving belt.

30. The moving orifice applicator of claim 21, further comprising means for adjusting tension in said continuous moving belt.

31. The moving orifice applicator of claim 21, wherein said drive means includes means for steering said continuous moving belt.

32. The moving orifice applicator of claim 18, wherein said substrate comprises a paper web and said fluid material comprises a slurry applied to said paper web to alter burn rate characteristics of said paper web.

33. A moving orifice applicator for applying a fluid material to a moving web, while said moving web passes underneath said moving orifice applicator, comprising:

a frame with two ends, with two brackets disposed at said ends of said frame, one of said brackets holding a drive wheel and second of said brackets holding an idler wheel;

a means for driving said drive wheel;

a continuous moving belt having an inner surface and an outer surface, said continuous moving belt having a plurality of orifices, said inner surface of said continuous moving belt mounted on said drive wheel and said idler wheel, said continuous moving belt having a lower traverse, said lower traverse passing directly above said moving web, plane of said lower traverse parallel to plane of said moving web, direction of motion of said lower traverse at an angle to direction of motion of said moving web, said drive wheel driving said continuous moving belt at a constant velocity so that said orifices in said lower traverse of said continuous moving belt pass across width of said moving web;

a cavity block located above said moving web and inside traverse of said continuous moving belt, said cavity block enclosing a cavity on five sides with bottom of said cavity exposed, said bottom of said cavity block enclosed by a portion of said inner surface of said continuous moving belt during said lower traverse of said continuous moving belt, said cavity block having a plurality of inlets for admitting said fluid material to said cavity, said orifices in said portion of said lower traverse of said continuous moving belt forming said bottom of said cavity block in communication with said cavity so that said fluid material in said cavity is discharged under pressure through said orifices and onto said moving web;

a means for guiding said portion of said lower traverse of said continuous moving belt forming said bottom of said cavity block; and a means for supplying said fluid material under pressure to said plurality of inlets in said cavity block pressure.

34. The moving orifice applicator of claim 33, wherein said guide means comprises a shield and a cavity floor, said shield and said cavity floor mounted below said cavity block, said shield positioned above said portion of said continuous moving belt forming said bottom of said cavity block, said shield substantially covering said continuous moving belt except for a slot in said shield, said slot aligning with said orifices in said continuous moving belt so said orifices remain in communication with said cavity, said cavity floor positioned below said portion of said continuous moving belt which forms said bottom of said cavity block, said cavity floor substantially covering said continuous moving belt except for a slot in said cavity floor, said slot in said cavity floor aligning with said orifices in said continuous moving belt, said shield and said cavity floor forming a guide wherein said continuous moving belt passes.

35. The moving orifice applicator of claim 33, wherein said angle of said lower traverse of said continuous moving belt is variable.

36. The moving orifice applicator of claim 33, wherein said pressure of said fluid material supplied by said supply means is variable.

37. The moving orifice applicator of claim 33, wherein said constant velocity of said continuous moving belt is variable over a range of velocities.

38. The moving orifice applicator of claim 33, wherein said orifices are of substantially equal size.

39. The moving orifice applicator of claim 33, wherein said orifices in said continuous moving belt are arranged in a repetitive pattern of varying sizes.

40. The moving orifice applicator of claim 33, wherein said orifices are substantially equally spaced along said continuous moving belt.

41. The moving orifice applicator of claim 33, wherein said orifices are spaced along said continuous moving belt in a repetitive pattern of varying spacings.

42. The moving orifice applicator of claim 33, wherein said orifices are disposed along the centerline of said continuous moving belt.

43. The moving orifice applicator of claim 33, wherein tension in said continuous moving belt is adjusted by a tensioning means.

44. The moving orifice applicator of claim 33, wherein said continuous moving belt is steered by a steering means.

45. A method of applying a fluid material to a substrate, comprising the steps of;

(a) moving said substrate alone a first path;

(b) moving at least one orifice along a second endless path, said second path including a second path portion which crosses said first path; and (c) discharging said fluid material under pressure through said at last one orifice and onto said substrate by communicating said fluid material with said at least one orifice while said at least one orifice moves along said second portion, wherein said substrate comprises a paper web and said fluid material comprises a slurry applied to said paper web to alter burn rate characteristics of said paper web.

* * * * *